US007810944B2

(12) United States Patent
Liao

(10) Patent No.: US 7,810,944 B2
(45) Date of Patent: Oct. 12, 2010

(54) ILLUMINATED CAP HAVING OPTICAL FIBER STRAND AND REMOVABLE POUCH

(75) Inventor: Sung-Yie Liao, Heping Shiang (TW)

(73) Assignee: Chuan Cheng Hat Co., Ltd., Taichung County (TW)

( * ) Notice: Subject to any disclaimer, the term of this patent is extended or adjusted under 35 U.S.C. 154(b) by 57 days.

(21) Appl. No.: 12/330,649

(22) Filed: Dec. 9, 2008

(65) Prior Publication Data

US 2010/0142192 A1 Jun. 10, 2010

(51) Int. Cl.
*F21V 21/084* (2006.01)
*F21V 7/04* (2006.01)

(52) U.S. Cl. ..... 362/106; 362/105; 362/570; 362/103; 362/555

(58) Field of Classification Search ..... 362/105–107, 362/570, 103, 249.02, 555
See application file for complete search history.

(56) References Cited

U.S. PATENT DOCUMENTS 3,758,771 A * 9/1973 Frohardt et al. ..... 362/570
4,797,793 A * 1/1989 Fields ..... 362/105
5,588,736 A * 12/1996 Shea, Sr. ..... 362/570
5,680,718 A * 10/1997 Ratcliffe et al. ..... 40/329
5,931,559 A * 8/1999 Pfaeffle ..... 362/106
6,935,761 B2 * 8/2005 Vanderschuit ..... 362/106
7,147,338 B2 * 12/2006 Gregg ..... 362/106
2009/0068394 A1 * 3/2009 Noelle et al. ..... 428/100

* cited by examiner

*Primary Examiner*—Ismael Negron

(57) ABSTRACT

An illuminated cap includes a crown having a visor, with a folding member on an inner surface of the crown proximate an ear portion thereof. A light source assembly includes a circuit board, two light emitting members connected to the circuit board, a switch on the circuit board, and at least one cell mounted on the circuit board. A receiving assembly, with the circuit board mounted therein, is fastened on the crown by the folding member which is adapted to separate the head of a wearer from the receiving assembly. A flexible optical fiber strand is disposed on the visor and/or along at least one stitch of the crown and has both ends electrically connected to the light emitting members respectively. The light emitting members (e.g., LEDs) are adapted to light or flash for warning surrounding persons or vehicles.

7 Claims, 6 Drawing Sheets

ILLUMINATED CAP HAVING OPTICAL FIBER STRAND AND REMOVABLE POUCH

BACKGROUND OF THE INVENTION

1. Field of Invention

The invention relates to caps and, more particularly, to a cap having an illuminated visor, crown, or both by incorporating light emitting members and an optical fiber strand so that a safe means for warning surrounding persons or vehicles by lighting or flashing the light emitting members and the optical fiber strand can be obtained.

2. Description of Related Art

Conventionally, caps are widely used by people throughout the world. Some types of caps are even designed for specific purposes. Typically, a person may wear a cap as a means of decoration or to protect against precipitation or sunlight while walking in the street. A type of flashlight has a clip so that the flashlight can be secured to a cap visor and is adapted to illuminate the front. Thus, a person wearing a cap equipped with the flashlight may have both hands free to, for example, carry items while walking in the night.

However, the well known illuminated cap suffers from a number of disadvantages. For example, light is only directed to the front. Hence, for example, a careless driver may unintentionally have his or her speeding car hit a person wearing the illuminated cap in front of the car since there is no light emitted rearward. This is not a safe design. Further, the cap has only an additional function of illumination. No flashing effect is provided. To the worse, its illumination is low because its light emitting device is poor in performance. Thus, the need for improvement still exists.

SUMMARY OF THE INVENTION

It is, therefore, one object of the invention to provide a cap having an illuminated visor, crown, or both by incorporating light emitting members and an optical fiber strand so that a safe means for warning surrounding persons or vehicles by lighting or flashing the light emitting members and the optical fiber strand can be obtained.

For achieving the above and other objects, an illuminated cap according to the invention includes a crown having a forward visor. A first space is defined by the crown, with the first space having a bottom opening. A folding member is on an inner surface of the crown proximate an ear portion thereof, and a second space is formed when the folding member is unfolded. The illuminated cap further includes a light source assembly having a circuit board, at least one light emitting member, a cord interconnecting the circuit board and the at least one light emitting member, a switch on the circuit board, and at least one cell releasably mounted on the circuit board. The illuminated cap also includes a receiving assembly having a third space for mounting the circuit board, with the receiving assembly being fastened on the crown by the folding member which is adapted to separate the head of a wearer from the receiving assembly. An elongated flexible optical fiber strand is disposed on at least one of the visor and the crown and has both ends electrically connected to the at least one light emitting member.

The above and other objects, features and advantages of the invention will become apparent from the following detailed description taken with the accompanying drawings.

DETAILED DESCRIPTION OF THE INVENTION

Figure 1:
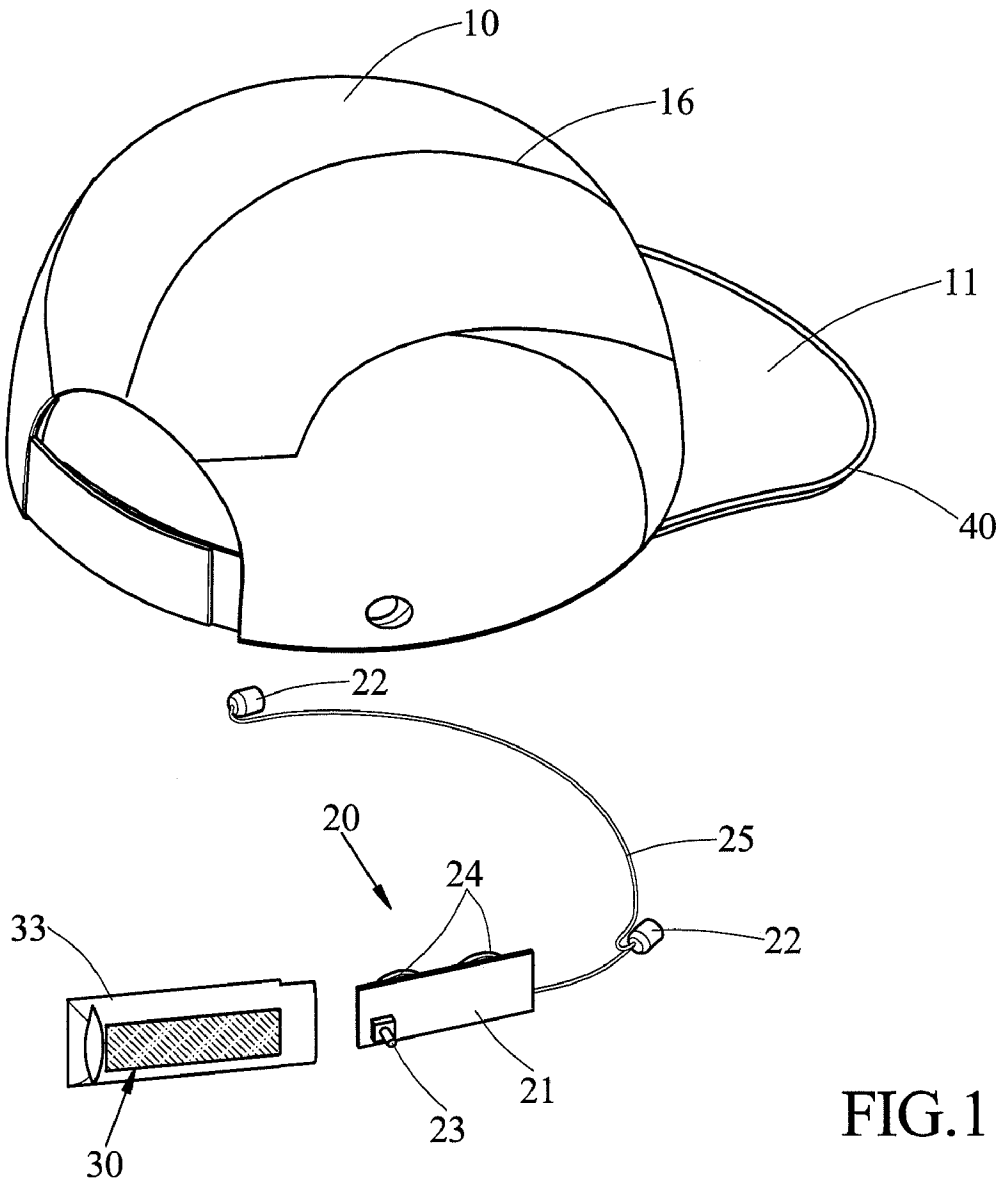
FIG. 1 is an exploded perspective view of an illuminated cap according to the invention.
Figure 2:
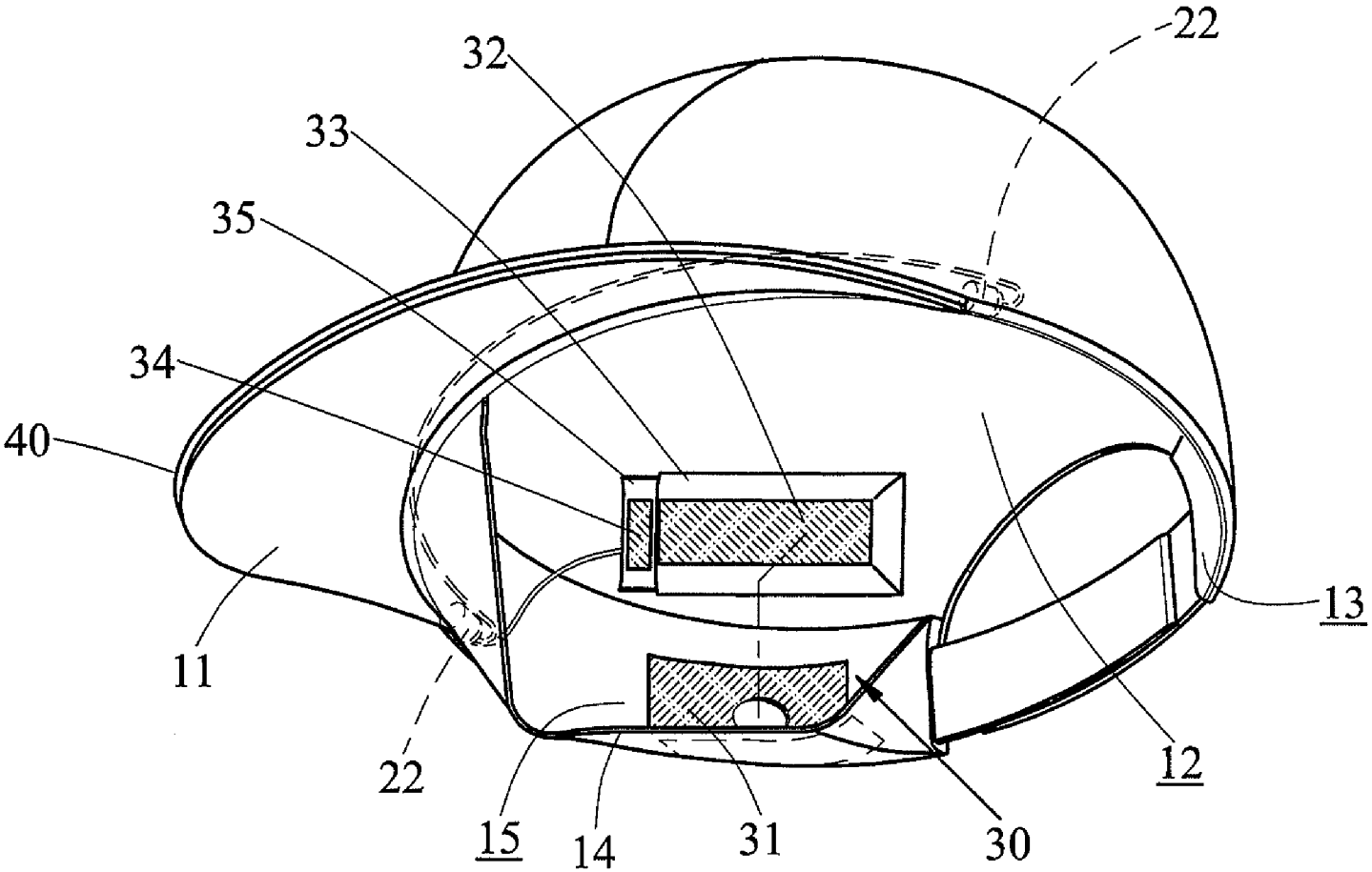
FIG. 2 is a perspective view of the assembled illuminated cap taken from the bottom.

Referring to FIGS. 1 and 2, an illuminated cap in accordance with the invention is shown. The cap comprises the following components each being discussed in detail below.

A crown 10 is made of fabric or synthetic fiber. The crown 10 has a forward visor 11. A space 12 is defined by the crown 10. The space 12 has a bottom opening 13. A folding member 14 is provided on an inner surface of the crown 10 proximate the ear portion thereof. A space 15 is formed when the folding member 14 is unfolded.

A light source assembly 20 comprises a circuit board 21, at least one light emitting member (two are shown) 22, a cord 25 interconnecting the circuit board 21 and the light emitting members 22, a switch 23 on the circuit board 21 and adapted to protrude out of the ear portion of the crown 10 for ease of pressing operation, and a plurality of cells 24 releasably mounted on the circuit board 21.

A receiving assembly (not numbered) comprises a space for mounting the circuit board 21. The receiving assembly is implemented as a fabric hook and loop fastener and pouch assembly 30 comprising a first fabric hook and loop fastener 31 fixedly secured to the inner surface of the crown 10, a rectangular pouch 33 having a flap 35 on its opening, a second fabric hook and loop fastener 32 fixedly secured to one surface of the pouch 33, and a third fabric hook and loop fastener 34 fixedly secured to one surface of the flap 35. The circuit board 21 is disposed in the pouch 33. The third fabric hook and loop fastener 34 is pressed against the second fabric hook and loop fastener 32 to mount the circuit board 21 in the pouch 33 with the switch 23 projecting out of the ear portion of the crown 10. The second fabric hook and loop fastener 32 is pressed against the first fabric hook and loop fastener 31 to seal the pouch 33 with the folding member 14 being sandwiched by the head of a wearer and the pouch 33.

An elongated optical fiber strand 40 is flexible in nature. As shown, the optical fiber strand 40 is provided along the front edge of the visor 11 and has both ends electrically connected to the light emitting members 22 respectively. The optical fiber strand 40 may be provided along one or more stitches 16 along the crown 10 as detailed later or arranged as a special design on the crown 10 so as to obtain warning, illumination, and other specific purposes. Preferably, the light emitting members 22 are LEDs (light-emitting diodes) and are adapted to light, dim, or flash when activated.

Figure 3:
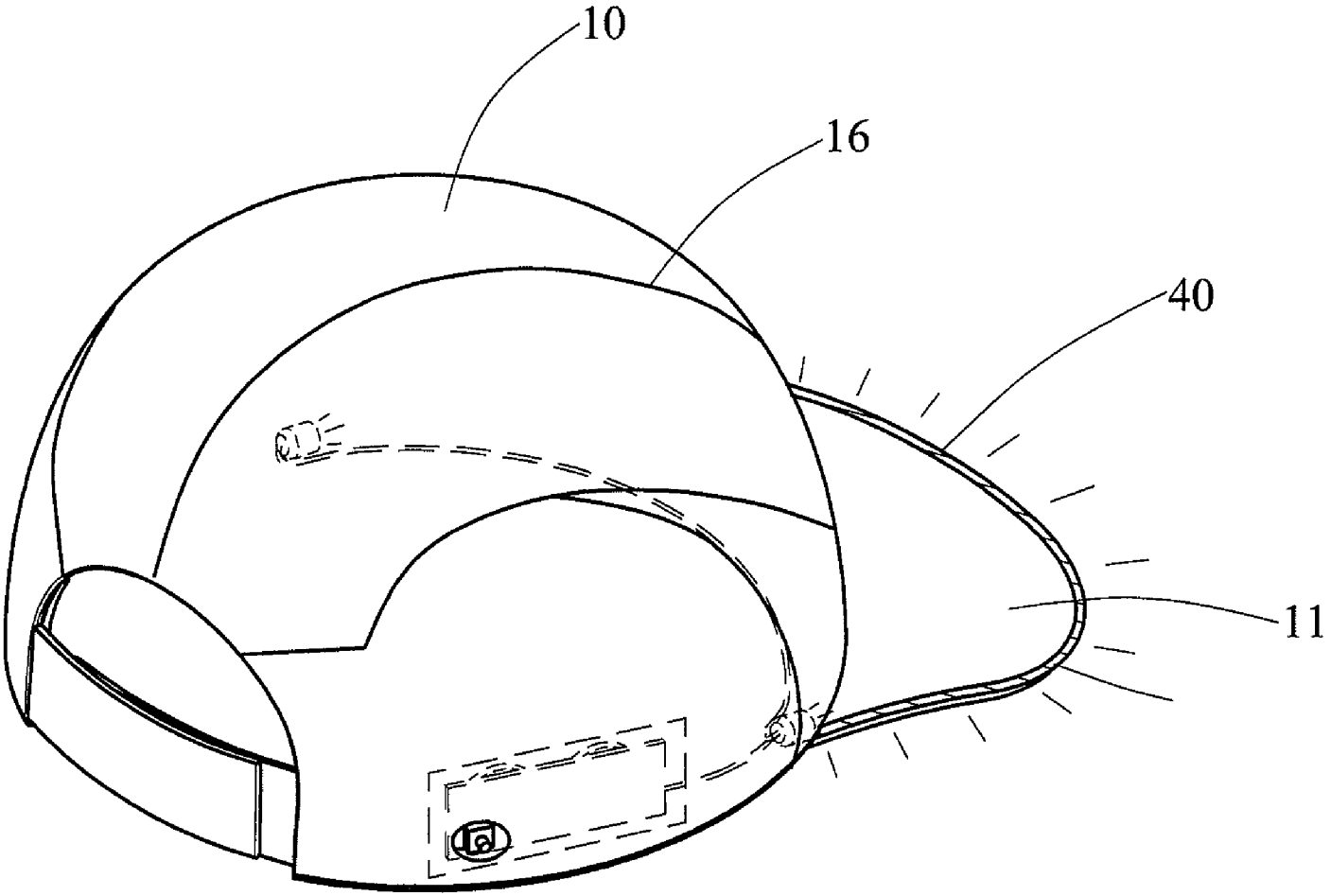
FIG. 3 is another perspective view of FIG. 2 where the cap is illuminated.

Referring to FIG. 3, the optical fiber strand 40 is provided along the front edge of the visor 11. Alternatively or in addition to, the optical fiber strand 40 may be provided xalong one or more stitches 16 along the crown 10 so as to obtain warning, illumination, and other specific purposes.

Referring to FIGS. 1 and 2 again, a wearer may press the switch 23 to enable the light emitting members 22 to emit light, dim, or flash. The optical fiber strand 40 will be lit when the light emitting members 22 are activated. Hence, the provision of the optical fiber strand 40 has the effects of increasing illumination portions of a cap, warning, and being aesthetic.

Figure 4:
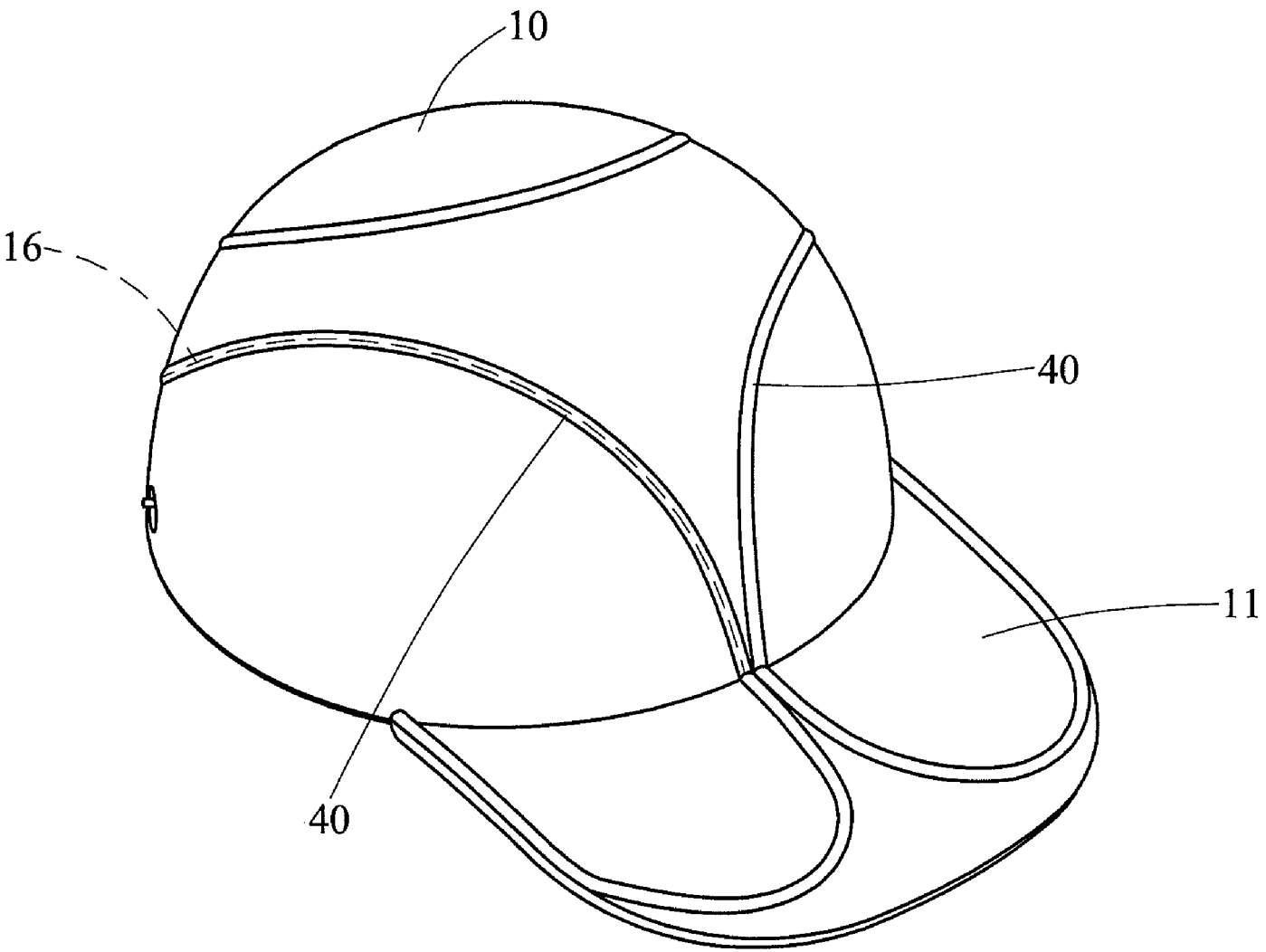
FIGS. 4 and 5 are perspective views showing two different designs of an optical fiber strand on visor and crown respectively.
Figure 5:
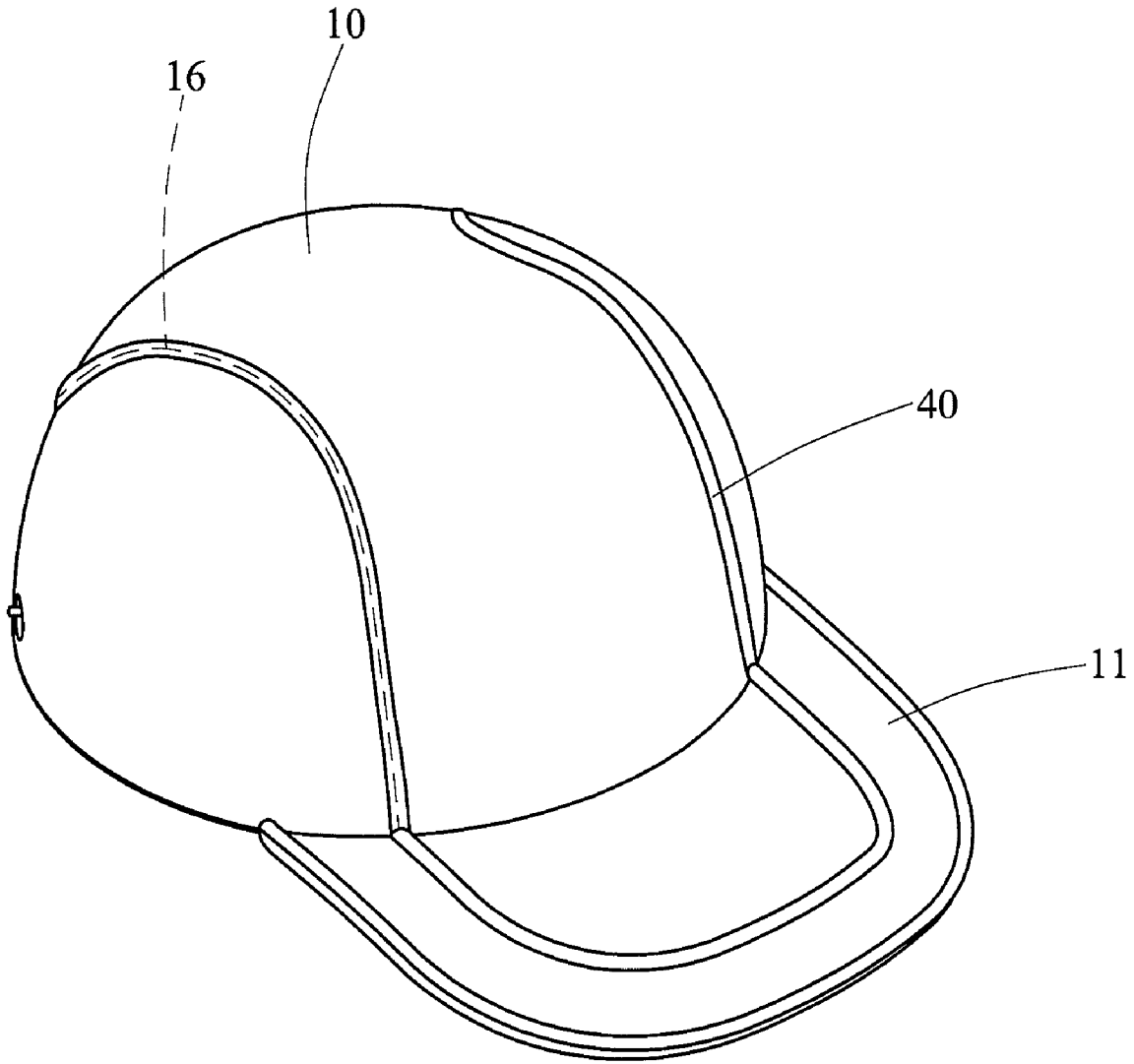

Referring to FIGS. 4 and 5, the optical fiber strand 40 is provided on both the visor 11 and the curved stitches 16 of the crown 10 in two different aesthetic designs.

Figure 6:
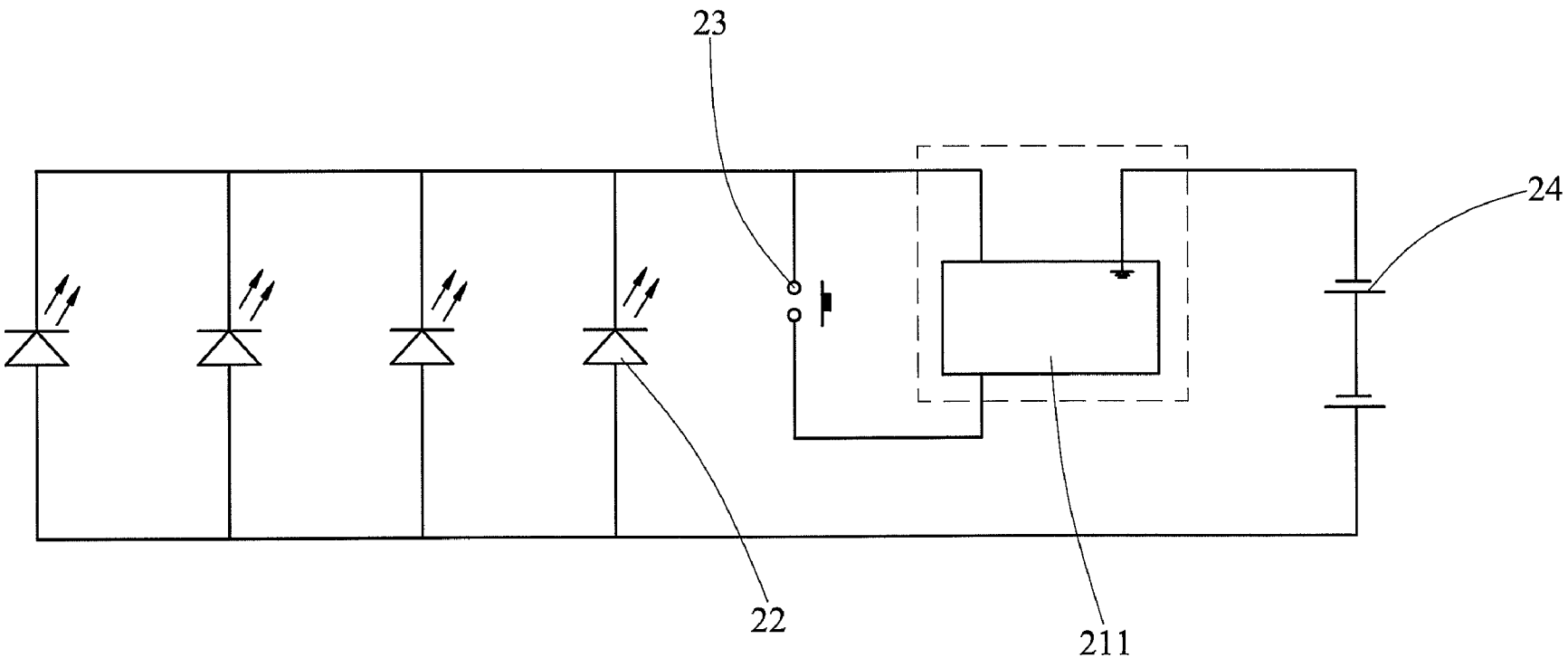
FIG. 6 is an electrical circuit diagram of the light source assembly according to the invention.

Referring to FIG. 6, a circuit diagram of the light source assembly is shown. The light source assembly comprises an IC (integrated circuit) 211, the switch 23, the light emitting members 22, and the cells 24. The switch 23, the light emitting members 22, and the cells 24 are electrically connected to the IC 211. A wearer may press the switch 23 to enable the light emitting members 22 to light, dim, or flash.

While the invention herein disclosed has been described by means of specific embodiments, numerous modifications and variations could be made thereto by those skilled in the art without departing from the scope and spirit of the invention set forth in the claims.

What is claimed is:

1. An illuminated cap comprising:

a crown defining a first space having a bottom opening;

a folding member attached to the bottom opening, such that the folding member is moveable between a folded position against an inner surface of the crown and an unfolded position spaced from the inner surface, with a second space defined between the folding member and the inner surface of the crown;

a visor extending forwardly from the crown;

a light source assembly comprising a circuit board, at least one light emitting member, a cord interconnecting the circuit board and the at least one light emitting member, a switch on the circuit board, and at least one cell releasably mounted on the circuit board;

a receiving assembly comprising a third space receiving the circuit board and the at least one cell, with the receiving assembly disposed within the third space and secured to the crown by the folding member in the folded position, the receiving assembly being removable from the first space when the folding member is in the unfolded position, the folding member in the folded position separating the head of a wearer from the receiving assembly; and an elongated flexible optical fiber strand disposed on at least one of the visor and the crown and having both ends optically connected to the at least one light emitting member.

2. The illuminated cap of claim 1, wherein the crown further comprises one or more stitches extending spaced from the bottom opening and the visor, and wherein the optical fiber strand is disposed along the one or more stitches.

3. The illuminated cap of claim 2, wherein the one or more stitches extends from the bottom opening away from the forward visor.

4. The illuminated cap of claim 3, wherein each of the at least one light emitting members is an LED and is adapted to light, dim, or flash.

5. The illuminated cap of claim 3, wherein the crown is formed of fabric.

6. The illuminated cap of claim 3, wherein the crown is formed of synthetic fiber.

7. The illuminated cap of claim 3, the receiving assembly comprising a first fabric hook and loop fastener fixedly secured to the inner surface of the crown, and a pouch formed separate from the crown and the folding member, pouch having an opening and a flap extending over the opening, the circuit board and the at least one cell receivable through the opening and unable to be removed from the pouch except through the disposed therein and having a flap on its opening, the receiving assembly further comprising a second fabric hook and loop fastener fixedly secured to one surface of the pouch, and a third fabric hook and loop fastener fixedly secured to one surface of the flap; wherein the third fabric hook and loop fastener is adapted to press against the second fabric hook and loop fastener to mount the circuit board in the pouch with the switch projecting out of the ear portion of the crown, and wherein the second fabric hook and loop fastener is adapted to press against the first fabric hook and loop fastener to seal the pouch.

* * * * *